US011415127B2

(12) United States Patent
Gable et al.

(10) Patent No.: US 11,415,127 B2
(45) Date of Patent: Aug. 16, 2022

(54) WELL SERVICE PUMP SYSTEM STRUCTURAL JOINT HOUSING HAVING A FIRST CONNECTOR AND A SECOND CONNECTOR EACH INCLUDING ONE OR MORE LANDS AND GROOVES THAT ARE CONFIGURED TO MATE WITH CORRESPONDING LANDS AND GROOVES IN AN END CYLINDER HOUSING AND A RAM CYLINDER HOUSING

(71) Applicant: AMERIFORGE GROUP INC., Houston, TX (US)

(72) Inventors: Tom Gable, Houston, TX (US); Garrett Smith, Houston, TX (US); Steven E. Daniels, Houston, TX (US); Mark C. Blanpied, Houston, TX (US); Carl D. Plemons, Houston, TX (US)

(73) Assignee: AMERIFORGE GROUP INC., Houston, TX (US)

( * ) Notice: Subject to any disclaimer, the term of this patent is extended or adjusted under 35 U.S.C. 154(b) by 410 days.

(21) Appl. No.: 16/396,121

(22) Filed: Apr. 26, 2019

(65) Prior Publication Data

US 2019/0331110 A1 Oct. 31, 2019

Related U.S. Application Data

(60) Provisional application No. 62/664,074, filed on Apr. 27, 2018.

(51) Int. Cl.
*F04B 53/16* (2006.01)
*F04B 53/02* (2006.01)
(Continued)

(52) U.S. Cl.
CPC ..... *F04B 53/162* (2013.01); *F04B 53/02* (2013.01); *E21B 41/00* (2013.01); *F04B 15/02* (2013.01)

(58) Field of Classification Search
CPC ..... F04B 15/02; F04B 53/02; F04B 53/162; F04B 17/06; F04B 47/04; F04B 53/16;
(Continued)

(56) References Cited

U.S. PATENT DOCUMENTS 2,532,779 A * 12/1950 Parks ..... F16C 35/077 384/428
2,766,701 A * 10/1956 Giraudeau ..... F04B 53/162 417/568

(Continued)

OTHER PUBLICATIONS

International Preliminary Report on Patentability Issued in Corresponding PCT Patent Application No. PCT/US2019/029469, dated Jun. 24, 2020.

(Continued)

*Primary Examiner* — Kenneth J Hansen
*Assistant Examiner* — Benjamin Doyle
(74) *Attorney, Agent, or Firm* — Norton Rose Fulbright US LLP

(57) ABSTRACT

A well service pump system for supplying working fluid to a well, the pump system having structural joint coupled to and extending between the housing of a hydraulic ram cylinder and the housing of a working fluid end cylinder that maintains the distance between the housings and stabilizes the housings relative to one another without interfering with the operation of the pump system. The structural joint further permits the use of minimal supporting structures for securing the hydraulic ram cylinder and working fluid end cylinder to a surface, such as the bed of a trailer.

18 Claims, 5 Drawing Sheets

(51) Int. Cl.
*E21B 41/00* (2006.01)
*F04B 15/02* (2006.01)

(58) Field of Classification Search
CPC .. F04B 9/10; E21B 41/00; F16B 21/06; F16B 21/065; F16B 21/07; F16B 21/08; F16B 21/09; F16B 21/10; F16L 19/0206; F16L 49/00; F16L 49/02; F16L 49/04; F16L 49/06; F16L 21/06; F16L 21/065
USPC ..... 417/399; 285/419, 373
See application file for complete search history.

(56) References Cited

U.S. PATENT DOCUMENTS 3,373,695 A * 3/1968 Yohpe ..... F04B 53/00 417/569
3,405,646 A * 10/1968 Thoma ..... F01B 3/0041 91/499
3,650,638 A * 3/1972 Cole ..... F01L 25/04 417/346
3,773,438 A 11/1973 Hall
3,778,881 A * 12/1973 Knapp ..... B23P 6/00 29/888.06
3,792,939 A 2/1974 Zalis
3,847,511 A * 11/1974 Cole ..... F04B 11/005 417/342
3,967,542 A * 7/1976 Hall ..... F01B 11/02 92/85 B
4,003,297 A * 1/1977 Mott ..... F15B 15/1438 92/78
4,160,627 A * 7/1979 Cole ..... F04B 9/1172 251/63.4
4,269,569 A 5/1981 Hoover
4,398,898 A * 8/1983 Odom ..... E21B 17/07 175/321
4,470,771 A 9/1984 Hall
4,478,561 A * 10/1984 Elliston ..... F15B 3/00 417/400
4,500,267 A * 2/1985 Birdwell ..... F04B 15/02 417/342
4,541,779 A * 9/1985 Birdwell ..... F04B 15/02 417/342
4,581,981 A * 4/1986 Kusiak ..... B64C 13/42 92/151
4,611,973 A * 9/1986 Birdwell ..... F04B 15/02 417/342
4,665,558 A * 5/1987 Burke ..... B25J 9/144 901/22
5,171,136 A * 12/1992 Pacht ..... F04B 53/1025 137/454.4
5,246,355 A 9/1993 Matzner et al.
5,259,731 A 11/1993 Dhindsa et al.
5,385,452 A * 1/1995 Lyday ..... F01B 11/02 417/403
5,605,221 A * 2/1997 Foster ..... B65G 25/065 198/750.5
5,616,009 A * 4/1997 Birdwell ..... F04B 9/1178 417/342
5,839,888 A 11/1998 Harrison
5,845,796 A * 12/1998 Miller ..... B61G 9/08 213/49
6,389,341 B1 * 5/2002 Davis ..... B60G 21/103 701/37
6,439,103 B1 * 8/2002 Miller ..... F01B 29/00 92/128
6,827,479 B1 12/2004 Xia et al.
7,296,981 B2 * 11/2007 Strong ..... F04B 53/126 417/415
7,354,256 B1 * 4/2008 Cummins ..... F04B 15/02 417/338
7,404,704 B2 * 7/2008 Kugelev ..... F04B 53/1032 417/454
7,413,063 B1 * 8/2008 Davis ..... B60G 17/06 188/267.1
9,121,397 B2 * 9/2015 Marica ..... F04B 11/00
9,650,879 B2 5/2017 Broussard et al.
9,945,362 B2 * 4/2018 Skurdalsvold ..... F04B 39/122
10,781,803 B2 * 9/2020 Kumar ..... F04B 53/162
2004/0167738 A1 8/2004 Miller
2004/0256162 A1 * 12/2004 Helms ..... E21B 7/062 175/325.2
2005/0132824 A1 * 6/2005 Krone ..... G01D 11/245 73/865.9
2006/0032369 A1 * 2/2006 Rafn ..... F15B 15/1447 92/128
2006/0228225 A1 * 10/2006 Rogers ..... F04B 51/00 417/63
2007/0090035 A1 * 4/2007 Rahn ..... G01N 30/603 210/198.2
2008/0008606 A1 1/2008 Muth et al.
2010/0107864 A1 * 5/2010 Bushner ..... F15B 15/18 91/422
2010/0300279 A1 * 12/2010 Kadlicko ..... F15B 15/18 91/361
2011/0162187 A1 * 7/2011 Patel ..... F04B 23/00 29/428
2011/0293447 A1 * 12/2011 Marica ..... F04B 47/08 417/392
2012/0234539 A1 * 9/2012 Brunet ..... F01M 9/02 166/285
2012/0279721 A1 * 11/2012 Surjaatmadja ..... F04B 53/10 166/369
2013/0112073 A1 * 5/2013 Studt ..... F04B 53/147 92/153
2013/0312601 A1 * 11/2013 Subrt ..... F15B 15/2892 92/5 R
2014/0322050 A1 * 10/2014 Marette ..... F04B 47/02 417/437
2015/0192117 A1 * 7/2015 Bridges ..... F04B 17/05 417/53
2016/0153443 A1 * 6/2016 Glass ..... F04B 51/00 417/53
2017/0037848 A1 * 2/2017 Robison ..... E21B 43/126
2017/0107779 A1 * 4/2017 Akhare ..... E21B 29/08
2017/0175799 A1 6/2017 Arnold
2017/0204852 A1 * 7/2017 Barnett, Jr. ..... F04B 53/10
2017/0211565 A1 * 7/2017 Morreale ..... F04B 39/125
2017/0226839 A1 8/2017 Broussard et al.
2017/0292358 A1 10/2017 Elish et al.
2019/0040727 A1 2/2019 Oehring et al.
2019/0219213 A1 * 7/2019 Tuck ..... F16L 55/172
2020/0378411 A1 * 12/2020 Luc ..... F16J 7/00

OTHER PUBLICATIONS

Written Opinion Issued in Corresponding PCT Patent Application No. PCT/US2019/029469, dated Mar. 30, 2020.
International Search Report and Written Opinion issued in Corresponding International Patent Application No. PCT/US2019/029469, dated Jul. 4, 2019.
Written Opinion Issued in Corresponding International Patent Application No. PCT/US2019/029469, dated Mar. 30, 2020.
Wehr Oil & Gas, QWS 2500SD, http://www.weiroilandgas.com/products_services/well_service_stimulation/well_service-stimulation_pumps/qws_2500sd.aspx?tab=features, Accessed: Sep. 14, 2015.
Wehr Oil & Gas, TWS 2500, http://www.weiroilandgas.com/products_services/well_service_stimulation/well_service-stimulation_pumps/destiny%E2%84%A2_tws_2500.aspx?tab=downloads, Accessed: Sep. 14, 2015.

* cited by examiner

WELL SERVICE PUMP SYSTEM STRUCTURAL JOINT HOUSING HAVING A FIRST CONNECTOR AND A SECOND CONNECTOR EACH INCLUDING ONE OR MORE LANDS AND GROOVES THAT ARE CONFIGURED TO MATE WITH CORRESPONDING LANDS AND GROOVES IN AN END CYLINDER HOUSING AND A RAM CYLINDER HOUSING

CROSS-REFERENCE TO RELATED APPLICATIONS

This application claims priority to U.S. Provisional Application No. 62/664,074, filed Apr. 27, 2018, the entire contents of which application are specifically incorporated by reference herein without disclaimer.

FIELD OF INVENTION

The present invention relates generally to pumping assemblies used for well servicing applications and, more particularly, concerns the stabilization and support of pumping assemblies with a structural joint.

BACKGROUND

Oil and gas wells require services such as fracturing, acidizing, cementing, sand control, well control and circulation operations. All of these services require pumps for pumping fluid down the well. Such pumps are generally part of a pumping system having an engine/motor, pumps, pump drive, and fluid end assembly. These elements may be positioned on the bed of a trailer and transported to a well site. One example of a pumping system is found in U.S. Patent Application Publication No. US 2015/0192117, which is incorporated by reference in its entirety.

SUMMARY

During transport and operation of a pumping system, pumping system components may be subject to various forces, such as vibration and mechanical stresses. Accordingly, it is important to secure and protect pumping system components such that undesired relative motion (and accompanying stress) is minimized. This is especially true for components of the pump itself, such as a hydraulic ram cylinder and working fluid ram cylinder, which may have components, such as a piston rod and plunger rod, that are subject to continuous and changing forces, usually at high pressures. However, the addition of traditional bracing typically adds an undesirable and/or impracticable amount of additional mass to a trailer, which can make the trailer more difficult and/or less-efficient to tow.

Accordingly, embodiments of the present apparatuses and methods disclose a structural joint that may be employed in a pump system between a hydraulic ram cylinder housing and a working fluid ram cylinder housing to securely maintain the housings in a spaced relation and to minimize relative movement of and bending forces experienced by the housings. The structural joint can further advantageously aid in securing pump components to a surface, such as the bed of trailer, by reducing the braces that would otherwise be required to maintain the relative positions and orientations of the cylinders. Other advantages and uses of the disclosed structural joint will be apparent to persons of ordinary skill in the art upon considering the remainder of this disclosure.

Some configurations of the present apparatuses and methods include a system (e.g., a well service pump system) comprising: a working fluid end cylinder having an end cylinder housing with a first end, a second end with a fluid port, and a plunger rod having a proximal end extending through the first end of the end cylinder housing, the plunger rod configured to reciprocate in the end cylinder housing; a hydraulic ram cylinder having a ram cylinder housing with a first end and a second end, a ram piston configured to reciprocate in the ram cylinder housing, and a piston rod coupled to the ram piston, the piston rod having a distal end extending from the second end of the ram cylinder housing and coupled to the plunger rod of the working fluid end cylinder such that the piston of the hydraulic ram cylinder can be actuated to move the plunger rod of the working fluid end cylinder: in a first direction to expel working fluid from the end of the end cylinder housing during a forward stroke of the plunger rod, and in a second direction to draw working fluid into the end cylinder housing during a return stroke of the plunger rod; and a structural joint having a joint housing extending along a length of the first end of the end cylinder housing, a distance between the end cylinder housing and the ram cylinder housing, and a length of the second end of the ram cylinder housing, the structural joint configured to maintain the distance between and resist bending of the end cylinder housing and the ram cylinder housing.

The joint housing can be generally cylindrical in shape and include connector portions coupled to each of its ends along its length that can facilitate connection of the joint housing with the ram cylinder housing and end cylinder housing, or with other elements of the well service pump system. The connector portions can integral with the joint housing, welded to the joint housing, or connected to the joint housing by other means, such as a bolted or threaded connection. In some embodiments, the connector portions include one or more lands and grooves (i.e., radially raised and recessed portions) that can mate with corresponding lands and grooves disposed on an interior or exterior surface of ends of the ram cylinder housing and end cylinder housing. The joint housing can be coupled to the ram cylinder housing and end cylinder housing in various ways, such as with bolts, by threading, with a fastener, and/or by friction. In some embodiments, the joint housing is connected at one its connector portions to the ram cylinder housing with a plurality of bolts extending through the connector portion into the ram cylinder housing. In some embodiments, the joint housing is connected at one of its connector portions to the end cylinder housing by a nut encircling and engaging threads on an outer surface of the end cylinder housing. The connector portions may include bolt holes, threads, or taper features to facilitate their connection to the ram cylinder housing and end cylinder housing.

The joint housing of the well service pump system can be a single piece or include a plurality of pieces. If employing a plurality of pieces, each piece can extend a full length of the joint housing and be removably coupled together to define the joint housing, for example, by having flanged surfaces that can be bolted together The joint housing pieces can each have a cross-sectional shape with an arcuate portion such that, when joined together, the pieces form a cylinder. In some embodiments, the joint housing pieces are substantially or entirely identical.

The well service pump system can also include a bracket positioned within the joint housing and configured to couple the piston rod to the plunger rod. Such bracket can be a single piece or made of multiple pieces. In some embodiments, the pump system can further include one or more supports configured to stabilize the ram housing, joint housing, and/or end housing. The supports can have a first end coupled to and supporting and exterior surface of the housing, for example with an arcuate shape that mates with the arcuate shape of the cylinder or joint housing. The supports can have a second end coupled to a surface, such as a bed of a trailer. Because the ram cylinder housing, joint housing, and end cylinder housing are rigidly coupled together, as described, the supports need not extend the entire length of any or all of the housing and can support a housing from a single, discrete location. This configuration can greatly reduce the structure needed to support hydraulic ram cylinder and working fluid end cylinder. In some embodiments, the supports can further include vibration dampening elements, such as those described in U.S. Patent Application Publication No. US 2015/0192117, such that forces from the movement of the surface, e.g., the bed of a trailer, are not substantially transferred to the ram cylinder housing, joint housing, and/or end cylinder housing.

In some embodiments, the end cylinder housing can include a radially expanded portion having an interior surface and an exterior surface. The radially expanded portion can be configured to receive: a piston wear ring having an exterior surface and interior surface, the piston wear ring configured to contact and reduce wear of the plunger rod as it reciprocates in the end cylinder housing; a plurality of seals configured to seal an annulus between an external surface of the plunger rod and an internal surface of the end cylinder housing, and a nut having an exterior surface and an interior surface, the nut configured to secure the piston wear ring and plurality of seals circumferentially within the radially expanded portion by coupling the exterior surface of the nut to the interior surface of the radially expanded portion of the end cylinder housing, and further coupling the interior surface of the nut to the exterior surface of the piston wear ring such that piston wear ring and plurality of seals are disposed circumferentially between the interior surface of the nut and the exterior surface of the plunger rod of the end cylinder housing. The nut can be threaded onto the piston wear ring and/or onto the radially expanded portion of the end cylinder housing. In some embodiments, a connector portion can help retain the piston wear ring, nut, and/or seals circumferentially within the radially expanded portion of the end cylinder housing when connected to the end cylinder housing.

Some embodiments of the present apparatuses and methods disclose a method of assembling a well service pump system such as any of the well service pump systems described herein. In some embodiments the method comprises: coupling a first end of a plunger rod of a working fluid cylinder to a first end of a piston rod of a hydraulic ram cylinder, the first end of the plunger extending through a first end of an end cylinder housing of the working fluid cylinder and configured to reciprocate within the end cylinder housing, and the first end of the piston rod extending from a first end of a ram cylinder housing of the hydraulic ram cylinder and configured to reciprocate within the ram cylinder housing; coupling the second end of the ram cylinder housing to a first end of a joint housing of a structural joint; and coupling the first end of the end cylinder housing to a second end of the joint housing of the structural joint, where the structural joint is configured to maintain the distance between and resist bending of the end cylinder housing and ram cylinder housing.

Some embodiment further include removably coupling a plurality of joint housing pieces together to define the joint housing. The joint housing pieces can each extend a full length of the joint housing. Some embodiments further include coupling connector portions of the joint housing to an end of the ram cylinder housing and an end of the end cylinder housing. The connector portions can be at the ends of the joint housing. Some embodiment further include securing the connector portions to the ends of the ram cylinder housing and end cylinder housing for example, by bolting one of the connector portions to the end of the ram cylinder housing and then threading a nut onto an outer surface of the end of the end cylinder housing that holds another connector portion onto the end of the end cylinder housing. This method facilitates easier connection of the ram cylinder housing and end cylinder housing to the joint housing by requiring specific radial locations (e.g., bolt holes) in only one end of the joint housing (e.g., the end closest to the ram cylinder housing) to be lined up with specific radial locations (e.g., bolt holes) in an adjacent housing (e.g., the ram cylinder housing) such that the other end of the joint housing may rotate relative to the end of the other adjacent housing (e.g., the end cylinder housing) while it is translationally secured to it.

Some embodiments further include positioning a plurality of seals and a piston wear ring within a radially expanded end portion of the end cylinder housing, the plurality of seals configured to seal an annulus between an external surface of the plunger rod and an internal surface of the end cylinder housing, and the piston wear ring configured to reduce wear of the plunger rod as it reciprocates in the end cylinder housing; and securing the plurality of the seals and piston wear ring within the end cylinder housing with a nut, the nut configured to be coupled to an exterior surface of the piston wear ring and an interior surface of the radially expanded portion of the end cylinder housing. Some embodiments further comprise coupling a first end of a support to an exterior surface of the ram housing, joint housing, or end housing and a second end of the support to a surface, the support configured to span less than the entire length of a housing.

Some embodiments of the present apparatus and methods include a structural joint for a well service pump system comprising a joint housing configured to be coupled to and stabilize adjacent cylinder housings, the joint housing further configured to extend the full distance between the lengths of the adjacent cylinder housings. The structural joint can include any of the configurations or elements explained herein, such as multiple pieces having a cross-sectional shape with an arcuate portion, connector portions with lands and grooves, and bolt holes, threads, tapers, or other features that permit coupling of the joint housing to other pump system components.

The term "coupled" is defined as connected, although not necessarily directly, and not necessarily mechanically; two items that are "coupled" may be unitary with each other. The terms "a" and "an" are defined as one or more unless this disclosure explicitly requires otherwise. The term "substantially" is defined as largely but not necessarily wholly what is specified (and includes what is specified; e.g., substantially 90 degrees includes 90 degrees and substantially parallel includes parallel), as understood by a person of ordinary skill in the art. In any disclosed embodiment, the term "substantially" may be substituted with "within [a percentage] of" what is specified, where the percentage includes 0.1, 1, 5, and 10 percent.

Further, a device or system that is configured in a certain way is configured in at least that way, but it can also be configured in other ways than those specifically described.

The terms "comprise" (and any form of comprise, such as "comprises" and "comprising"), "have" (and any form of have, such as "has" and "having"), and "include" (and any form of include, such as "includes" and "including") are open-ended linking verbs. As a result, an apparatus that "comprises," "has," or "includes" one or more elements possesses those one or more elements, but is not limited to possessing only those elements. Likewise, a method that "comprises," "has," or "includes" one or more steps possesses those one or more steps, but is not limited to possessing only those one or more steps.

Any embodiment of any of the apparatuses, systems, and methods can consist of or consist essentially of—rather than comprise/include/have—any of the described steps, elements, and/or features. Thus, in any of the claims, the term "consisting of" or "consisting essentially of" can be substituted for any of the open-ended linking verbs recited above, in order to change the scope of a given claim from what it would otherwise be using the open-ended linking verb.

The feature or features of one embodiment may be applied to other embodiments, even though not described or illustrated, unless expressly prohibited by this disclosure or the nature of the embodiments.

Some details associated with the embodiments described above and others are described below.

BRIEF DESCRIPTION OF THE DRAWINGS

The following drawings form part of the present specification and are included to further demonstrate certain aspects of the present invention. The invention may be better understood by reference to one or more of these drawings in combination with the detailed description of specific embodiments presented herein.

DESCRIPTION OF ILLUSTRATIVE EMBODIMENTS

Figure 1:
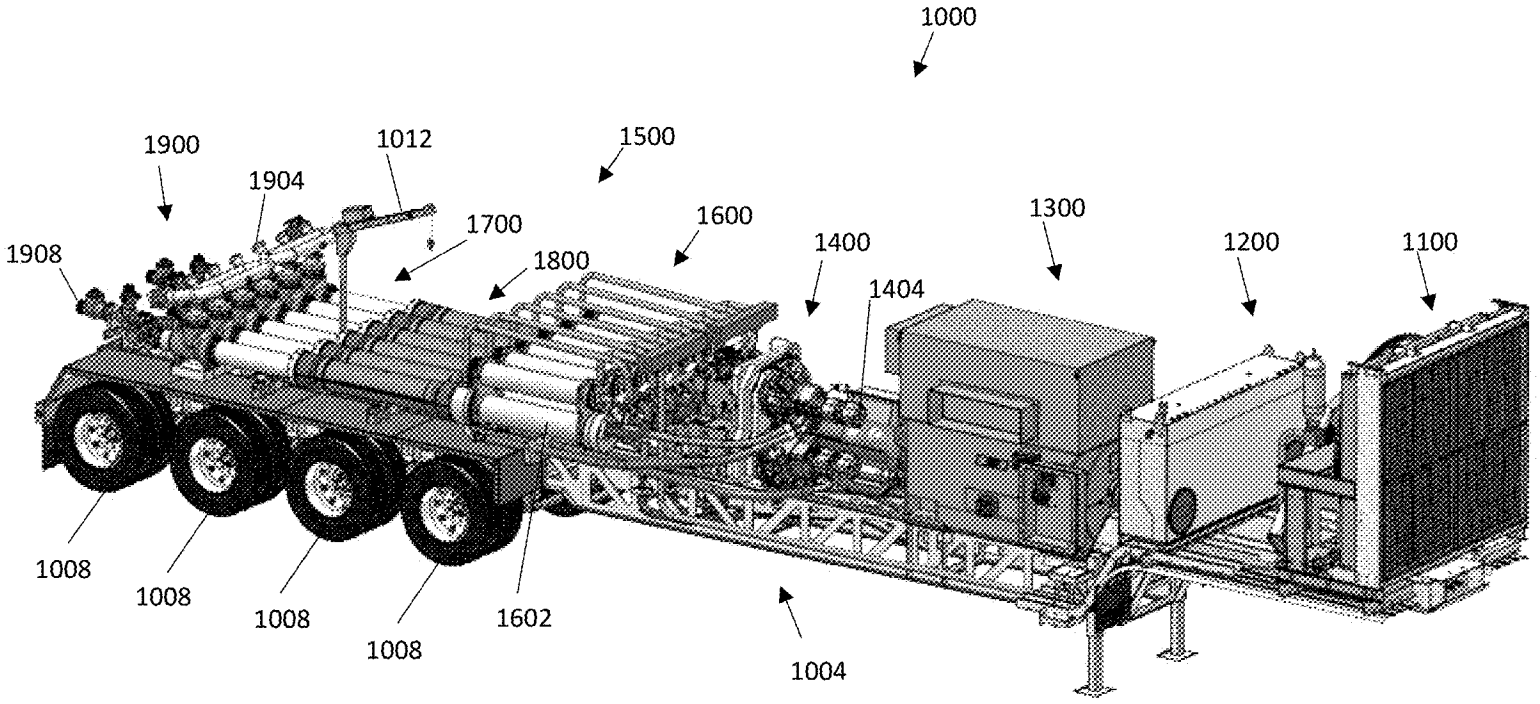
FIG. 1 is a perspective view of one example of the present well service pump systems.

Referring now to FIG. 1, shown therein and designated by the reference numeral 1000 is an embodiment of a well service pump system of the present apparatuses and methods. Pump system 1000 can be used to perform fracturing, acidizing, cementing, sand control, well control and/or circulation operations by pumping working fluids into a well. Many of the components of pump system 1000 are described in greater detail in U.S. Patent Application Publication No. US 2015/0192117, and will only be described briefly herein.

Pump system 1000 includes a number of components, including cooler 1100, reservoir 1200, motor 1300, pumps 1400, and a series of pump assemblies 1500 (six shown). Cooler 1100 can remove heat from one or more components of pump system 1000, such as from motor 1300 and/or reservoir 1200, during a pumping operation. Reservoir 1200 can hold hydraulic fluid that is used to actuate pump assemblies 1500. Motor 1300 can include one or more sources of mechanical energy, such as a diesel engine, gasoline engine, and/or an electric motor, and is used to power pumps 1400 via a pump drive 1404. For example, each pump 1400 can be powered to drive hydraulic fluid to a hydraulic ram cylinder, such as hydraulic ram cylinder 1602, to actuate a plunger rod, such as plunger rod 1708, as described herein. Engine/motor 1300 is coupled to a pump 1400 via a pump drive. Pump assemblies 1500 include hydraulic ram cylinder assemblies 1600, working fluid end cylinder assemblies 1700, and structure joints 1800. These pump assembly components will be described in more detail with reference to FIGS. 2 to 5C. Pump assemblies 1500 are connected to fluid end assembly 1900 that facilitates delivery of working fluid to (via suction manifold 1904) and from (via discharge manifold 1908) working fluid end cylinder assemblies 1700. Pump system 1000 also includes other components, such as crane 1012 for handling pump system components like components of fluid end assembly 1900.

Figure 2:
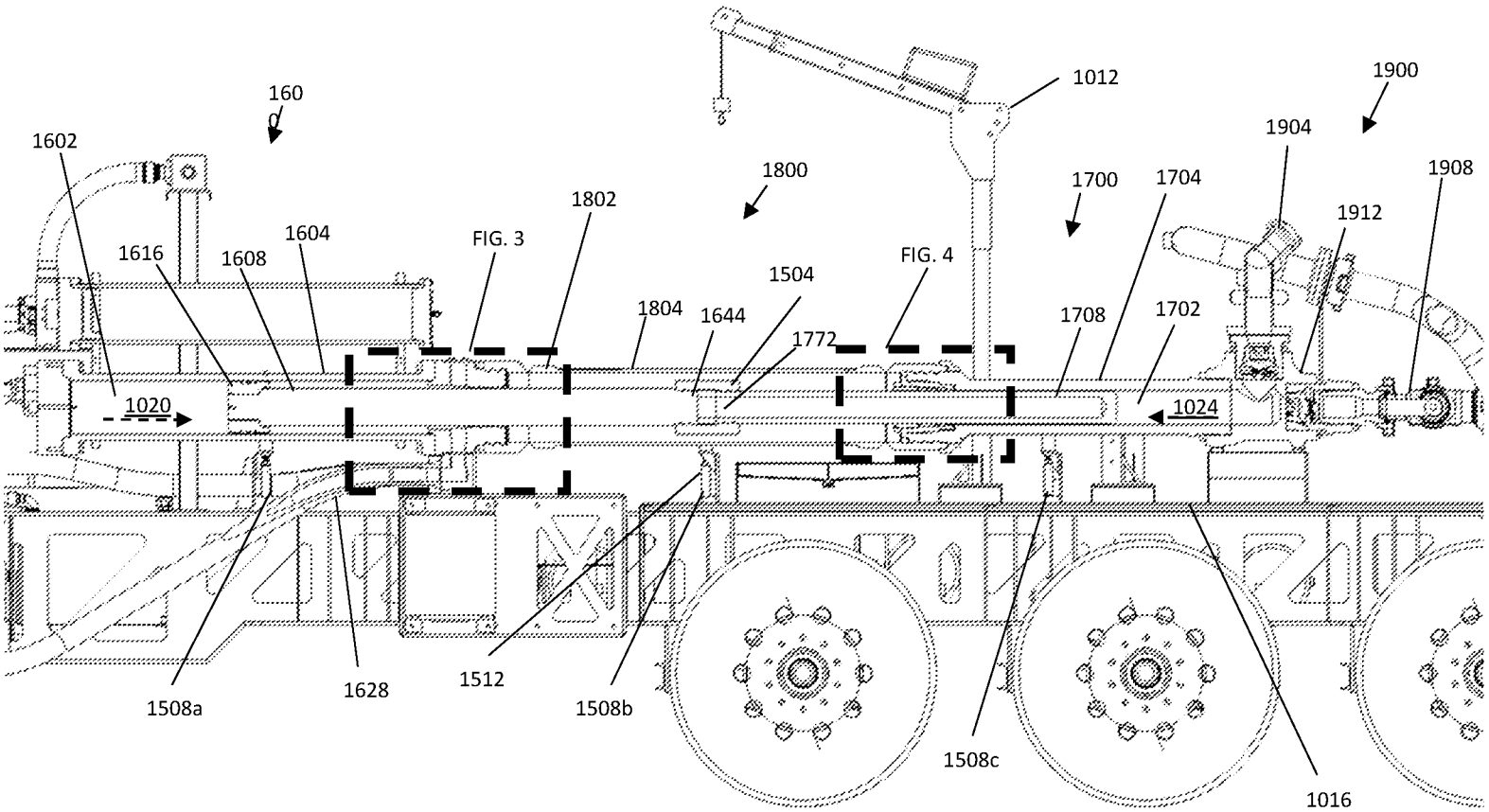
FIG. 2 is an enlarged, cross-sectional side view of a portion of the well service pump system of FIG. 1, taken along a line extending length-wise across hydraulic ram cylinder 1602.

Referring now to FIG. 2, hydraulic ram cylinder assembly 1600 includes a hydraulic ram cylinder 1602 having a ram cylinder housing 1604. Pumps 1400 pump hydraulic fluid into ram cylinder housing 1604 to drive ram piston 1616 disposed within ram cylinder housing 1604 in direction 1020. Ram piston 1616 can include sealing elements that prevent hydraulic fluid from passing by ram piston 1616 within ram cylinder housing 1604 such that substantially all of the force provided by the hydraulic fluid is transmitted into ram piston 1616. Ram piston 1616 is coupled to piston rod 1608 which is driven with piston head 1616 in direction 1020. Piston rod 1608 includes a distal end 1644 that protrudes from the distal end of ram cylinder housing 1604 and is coupled to proximal end 1772 of plunger rod 1708 of working fluid end cylinder assembly 1700. Plunger rod 1708 protrudes from the proximal end of end cylinder housing 1704 of working fluid end cylinder 1702. Distal end 1644 of piston rod 1608 can be coupled to proximal end 1772 of plunger rod 1708 by, for example, using a bracket 1504. Bracket 1504 can be a single unitary piece or made from multiple pieces and can be threaded, bolted, welded, or otherwise coupled to exterior surfaces of the piston rod 1608 and plunger rod 1708. Bracket 1504 has a maximum radial diameter less than the inner radial diameter of joint housing 1804 of structural joint 1802, such that piston rod 1608, bracket 1504, and plunger rod 1708 can reciprocate within joint housing 1804 without contacting joint housing 1804.

When driven by ram piston 1616, piston rod 1608 drives plunger rod 1708 further into end cylinder housing 1704, which decreases the fluid volume in end cylinder housing 1704, driving working fluid located in end cylinder housing 1704 through discharge manifold 1908 of fluid end 1912 of fluid end assembly 1900. The fluid discharged may be driven, for example, into a well to perform a well operation. After driving working fluid through discharge manifold 1908, plunger rod 1708 can be driven in direction 1024 by forcing hydraulic fluid through return line 1628 of hydraulic ram cylinder assembly 1600 into the annulus between piston rod 1608 and ram cylinder housing 1604 to drive ram piston 1616 in direction 1024. Working fluid can then be supplied (e.g., through suction) into end fluid cylinder 1702 through suction manifold 1904 in anticipation of a subsequent piston stroke.

As shown in FIG. 2, joint housing 1804 of structural joint 1802 extends along a length of the proximal end of the end cylinder housing 1704, a distance between the end cylinder housing 1704 and the ram cylinder housing 1604, and a length of the distal end of ram cylinder housing 1604. Joint housing 1804 is a rigid structure securely coupled to the proximal end of end cylinder housing 1704 and the distal end of ram cylinder housing 1604, as explained in more detail with reference to FIGS. 3 to 5C. Structural joint 1802 therefore maintains the distance between end cylinder housing 1704 and ram cylinder housing 1604. Structural joint 1802 additionally helps stabilize end cylinder housing 1704 and ram cylinder housing 1604, especially when plunger rod 1708 and piston rod 1608 are reciprocating within joint housing 1804. Further, structural joint 1802 permits ram cylinder housing 1604 and end cylinder housing 1704 to be supported on surface 1016 (e.g., a trailer bed) of trailer 1004 with a minimal amount of structure. Because ram cylinder housing 1604 is rigidly connected to end cylinder housing 1704 via structural joint 1802, as little as three thin, vertical supports 1508*a*, 1508*b*, 1508*c* can be used to support ram cylinder housing 1604, joint housing 1804, and end cylinder housing 1704, respectfully, on surface 1016. Using only a small number of supports 1508 greatly reduces the cost and complexity of supporting pump assembly 1500 on surface 1016. Supports 1508 can include a top end with a mating surface (e.g., having an arcuate shape) to receive the corresponding lower outer surface of ram cylinder housing 1604, joint housing 1804, and end cylinder housing 1704, as appropriate. Supports 1508 can further include other features such as vibration dampening elements 1512, which can be, for example, a pneumatic cylinder. Vibration dampening elements 1512 can help prevent transmission of forces from surface 1016 to ram cylinder housing 1604, joint housing 1804, and end cylinder housing 1704, as employed, which can further aid in stabilizing pump assembly 1500.

Figure 3:
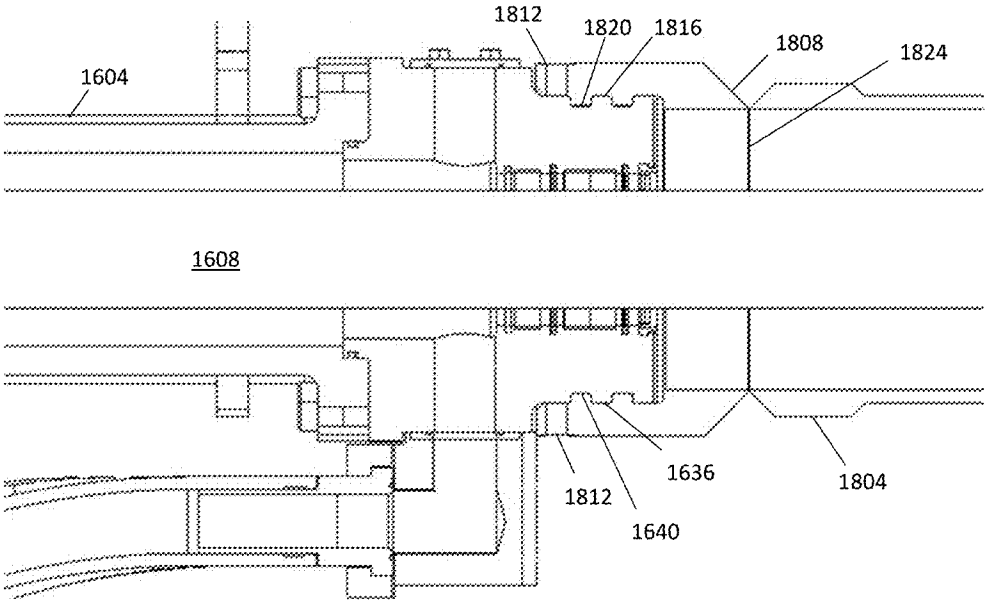
FIG. 3 is an enlarged, cross-sectional side view of a portion of the well service pump system of FIG. 1 showing details of a connection of a joint housing with a ram cylinder housing.

Referring now to FIG. 3, an embodiment of the connection of structural joint to 1802 to the distal end of ram cylinder housing 1604 will be described. As shown, joint housing 1804 of structural joint 1802 includes a first connector portion 1808 at one of its ends. Connector portion 1808 can be integral with joint housing 1804 or otherwise attached such as by welding or a threaded connection at location 1824. Connector portion 1808 includes circumferential lands 1816 and grooves 1820 on an interior surface of connector portion 1808 that are configured to mate with grooves 1636 and lands 1640, respectfully, on an exterior surface of the distal end of ram cylinder housing 1604. Connector portion 1808 can be secured to the distal end of ram cylinder housing 1604 by attaching one or more bolts through bolt holes 1812 in connector portions 1808 into ram cylinder housing 1604 such that the bolts do not interfere with the motion of piston rod 1608. Securing connector portion 1808 of j oint housing 1804 to ram cylinder housing 1604 in this configuration prevents relative motion between connector portion 1808 of joint housing 1804 in longitudinal and rotational directions (i.e., secures the ram cylinder housing from sliding longitudinally or rotating relative to the joint housing).

Figure 4:
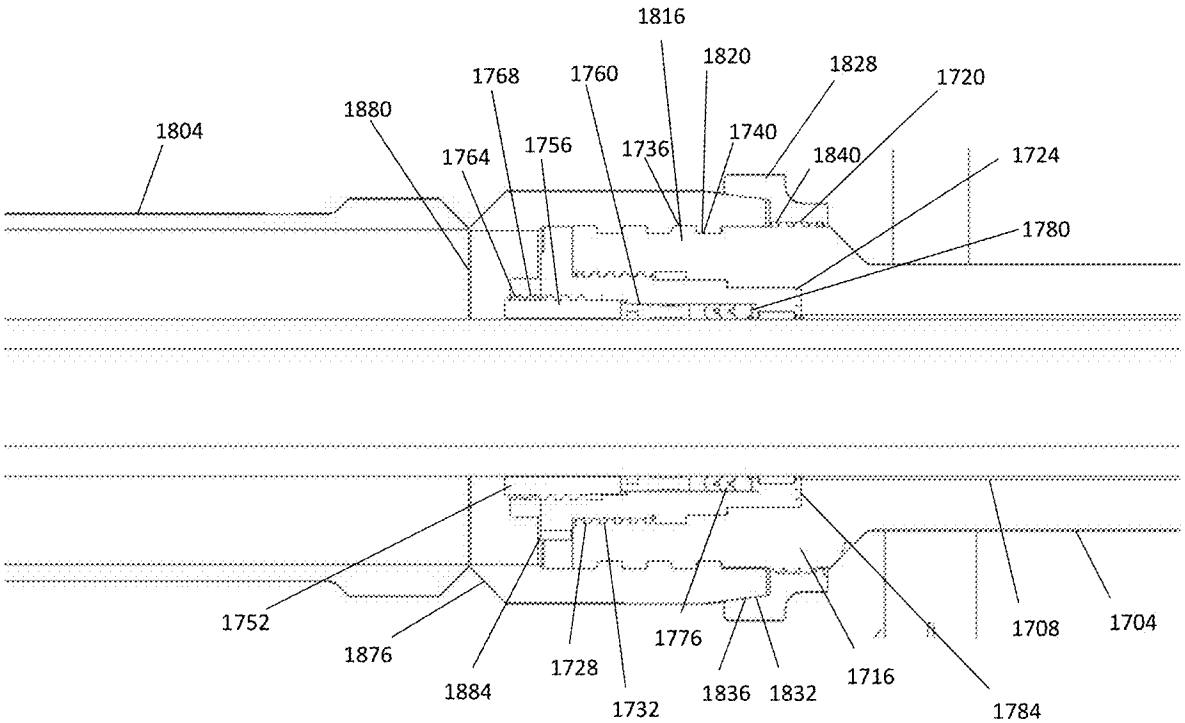
FIG. 4 is an enlarged, cross-sectional view of a portion of the well service pump system of FIG. 1 showing details of a connection of a joint housing with an end cylinder housing.

Referring now to FIG. 4, an embodiment of the connection of structural joint to 1802 to the proximal end of end cylinder housing 1704 will be described. As shown, joint housing 1804 of structural joint 1802 include a second connector portion 1876 at another one of its ends. Like connector portion 1808, connector portion 1876 can be integral with joint housing 1804 or otherwise attached such as by welding or a threaded connection at location 1880. Also like connector portion 1808, connector portion 1876 includes circumferential lands 1816 and grooves 1820 on an interior surface of connector portion 1876 that are configured to mate with grooves 1736 and lands 1740, respectfully, on an exterior surface of the proximal end of end cylinder housing 1704. Unlike connector portion 1808, connector portion 1876 does not include bolt holes. Instead, connector portion 1876 includes tapered surface 1836 at it end that is configured to mate with a corresponding receptacle 1832 of a threaded nut 1828. Threaded nut 1828 includes threads 1840 configured to mate with corresponding threads 1720 on an exterior surface of a radially-expanded portion 1716 on the proximal end of end cylinder housing 1704. Connector portion 1876 can therefore be secured to end cylinder housing 1704 by threading nut 1828 onto the exterior surface of portion 1716. Securing connector portion 1876 of joint housing 1804 to end cylinder housing 1704 in this configuration prevents relative motion between connector portion 1876 of joint housing 1804 longitudinally, but not necessarily rotationally. Not securing at least one end of the joint housing against rotation (at least during assembly), avoids the need to align the joint housing circumferentially relative to both cylinder housings and can thereby greatly simplify the ease of assembly.

One can more easily secure joint housing 1804 to ram cylinder housing 1604 and end cylinder housing 1704 when one only end of the joint housing 1804 is secured in both longitudinal and rotational directions so that both ends of joint housing 1804 are not required to be radially aligned with the ends of the housings before being secured thereto. Such a configuration is shown with reference to FIGS. 3 and 4. In particular, joint housing 1804 can be secured to ram cylinder housing 1604 with a bolted connection first and then end cylinder housing 1704 connected to joint housing 1804 with a threaded nut such that only the end of joint housing 1804 coupled to ram cylinder housing 1604 need be radially aligned. This permits easier and quicker connection of the joint housing to the pump assembly.

Returning to FIG. 4, also shown is a piston wear ring 1752 that is configured to guide and support plunger rod 1708. Piston wear ring 1752 is made from a material that is softer than the material of plunger rod 1708, such that piston wear ring 1752 will wear down from frictional contact with plunger rod 1708 during reciprocation of plunger rod 1708 rather than plunger rod 1708 wearing down from frictional contract with piston wear ring 1752. Piston wear ring includes two pieces (though only one may be employed). The first piece 1756 include threads 1764 on an outer surface of its end that mate with threads 1768 on an inner surface of an end of retaining nut 1724. The second piece 1760 does not include threading and may be replaced more cheaply as needed from wear than first piece 1756 because it does require threading. Also shown in FIG. 4 are a plurality of seals 1776 that are disposed between retaining nut 1724 and an outer surface of plunger rod 1708 to prevent fluid (e.g., working fluid) from flowing from the annulus (formed between the outer surface of the plunger rod 1708 and the inner surface of end cylinder housing 1704) into joint housing 1804.

Seals 1776 and piston wear ring 1752 are secured against piston rod 1708 by retaining nut 1724, which, as explained previously, is secured to the end of piston wear ring 1752 with a threaded connection. Retaining nut 1724 also includes a shoulder 1780 that retains seals 1776 at an end of retaining nut 1724 that is spaced apart from the end of retaining nut having threads 1768. Retaining nut 1724 is secured to radially-expanded portion 1716 of end cylinder housing 1704 by a threaded connection. In particular, retaining nut 1724 includes threads 1728 on an exterior surface that mate with corresponding threads 1732 on an interior surface of radially-expanded portion 1716 of end cylinder housing 1704. Retaining nut 1724 is further secured within radially-expanded portion 1716 by shoulder 1784 of end cylinder housing 1704 and shoulder 1884 of connector portion 1876.

Figure 5C:
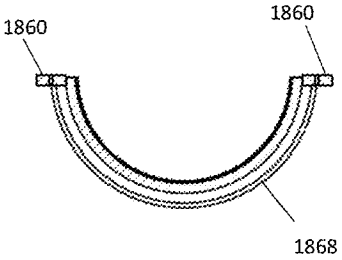
FIGS. 5A to 5C are a perspective view, side view, and cross-section view (along line A-A of FIG. 5B), respectfully, of a piece of one example of the present structural joints.
Figure 5A:
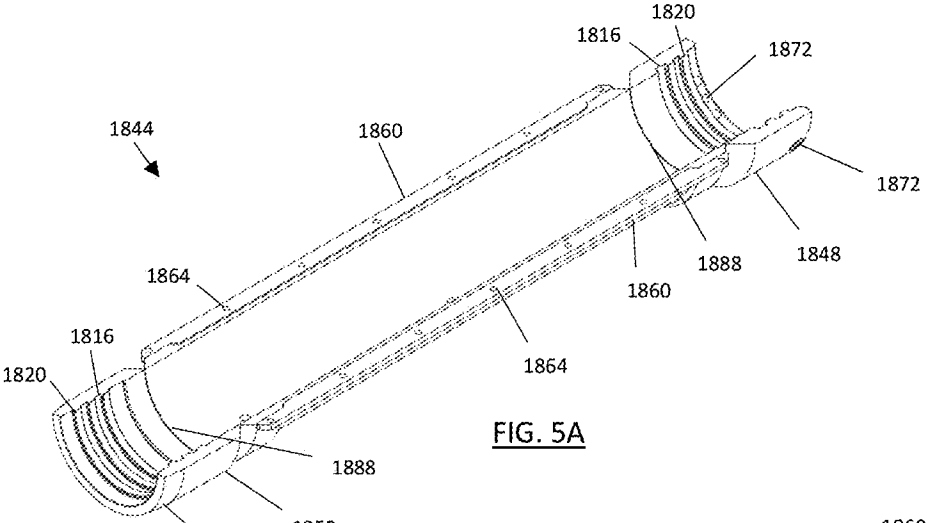
Figure 5B:
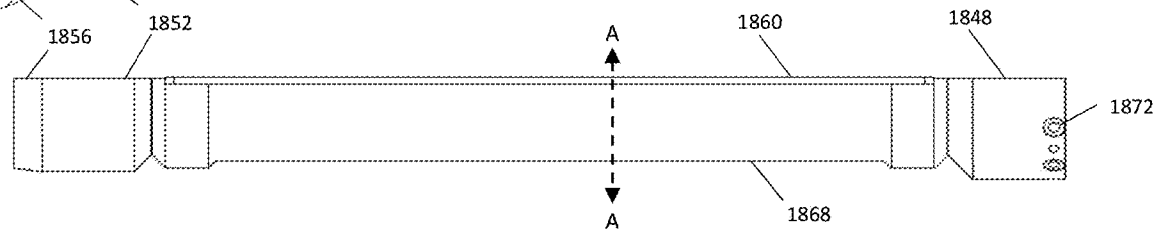

Referring now to FIGS. 5A to 5C, shown there and designated by reference numeral 1844 is a piece of a joint housing, such as joint housing 1804 of a structural joint 1802. Joint housing piece 1844 extends a full length of a joint housing and includes an arcuate portion 1868 and lands 1816 and grooves 1820 on the interior surface of each of its connector portions 1848, 1852. Connector portions 1848, 1852 may be integral with joint housing 1804 or otherwise attached such as by welds at locations 1888. Connector portions 1848, 1852 do not have identical configurations. Connector portion 1848 includes a plurality of bolt holes 1872 for facilitating a bolted connection of connector portion 1848 and another component of a pump assembly, such as a ram cylinder housing or end cylinder housing. Connector portion 1852 includes a tapered surface 1856 for facilitating a connection to another component of a pump assembly, such as a ram cylinder housing or end cylinder housing, by securing a nut (e.g., with a receptacle) into mating contact with tapered surface 1856. Joint housing piece 1844 may be coupled (including removably) to a substantially similar (e.g., identical) joint housing piece 1844 to form a joint housing, such as joint housing 1804. To facilitate such coupling, joint housing piece 1844 includes elongated flanges 1860 having a plurality of bolt holes 1864 that can align with corresponding structure of another joint housing piece such that bolts passing through bolt holes 1864 and the corresponding bolt holes of the other joint housing piece securely join the joint housing pieces together.

Forming a joint housing such as joint housing 1804 from multiple pieces such as joint housing pieces 1844 provides the advantage of being able to couple the joint housing to a ram cylinder housing (e.g., ram cylinder housing 1604) and end cylinder housing (e.g., end cylinder housing 1704) after a piston rod and plunger rod of such housings, such as piston rod 1608 and plunger rod 1708, respectively, are coupled together. It also allows easier access to such components because the joint housing pieces can be removably coupled (e.g., via bolts through bolt holes 1864). Forming a joint housing further permits easier mating of lands and grooves of the connector pieces with corresponding grooves and lands of a ram cylinder housing and/or end cylinder housing by permitting simple insertion of these corresponding elements.

The above specification and examples provide a complete description of the structure and use of illustrative embodiments. Although certain embodiments have been described above with a certain degree of particularity, or with reference to one or more individual embodiments, those skilled in the art could make numerous alterations to the disclosed embodiments without departing from the scope of this invention. As such, the various illustrative embodiments of the methods and systems are not intended to be limited to the particular forms disclosed. Rather, they include all modifications and alternatives falling within the scope of the claims, and embodiments other than the one shown may include some or all of the features of the depicted embodiment. For example, elements may be omitted or combined as a unitary structure, and/or connections may be substituted. Further, where appropriate, aspects of any of the examples described above may be combined with aspects of any of the other examples described to form further examples having comparable or different properties and/or functions, and addressing the same or different problems. Similarly, it will be understood that the benefits and advantages described above may relate to one embodiment or may relate to several embodiments.

The claims are not intended to include, and should not be interpreted to include, means-plus- or step-plus-function limitations, unless such a limitation is explicitly recited in a given claim using the phrase(s) "means for" or "step for," respectively.

The invention claimed is:

1. A well service pump system comprising:

a working fluid end cylinder having an end cylinder housing with a first end, a second end with a fluid port, and a plunger rod having a proximal end extending through the first end of the end cylinder housing, the plunger rod configured to reciprocate in the end cylinder housing;

a hydraulic ram cylinder having a ram cylinder housing with a first end and a second end, a ram piston configured to reciprocate in the ram cylinder housing, and a piston rod coupled to the ram piston, the piston rod having a distal end extending from the second end of the ram cylinder housing and coupled to the plunger rod of the working fluid end cylinder such that the piston of the hydraulic ram cylinder can be actuated to move the plunger rod of the working fluid end cylinder:

in a first direction to expel working fluid from the end of the end cylinder housing during a forward stroke of the plunger rod, and in a second direction to draw working fluid into the end cylinder housing during a return stroke of the plunger rod; and a structural joint having a joint housing extending along a length of the first end of the end cylinder housing, a distance between the end cylinder housing and the ram cylinder housing, and a length of the second end of the ram cylinder housing, the structural joint configured to maintain the distance between and resist bending of the end cylinder housing and the ram cylinder housing, where the joint housing includes a first connector portion at a first end of the joint housing and a second connector portion at a second end of the joint housing; and where the first and second connector portions each include one or more lands and grooves that are configured to mate with corresponding lands and grooves on the first end of the end cylinder housing and the second end of the ram cylinder housing.

2. The pump system of claim 1, where the joint housing comprises a plurality of joint housing pieces each extending a full length of the joint housing and removably coupled together to define the joint housing.

3. The pump system of claim 2, where each joint housing piece has a cross- sectional shape with an arcuate portion.

4. The pump system of claim 2, where the joint housing pieces are substantially identical.

5. The pump system of claim 1, where the first connector portion of the joint housing is secured to the second end of the ram cylinder housing with a plurality of bolts extending through the first connector portion into the ram cylinder housing, and the second connector portion of the joint housing is secured to the first end of the end cylinder housing by a nut encircling and engaging threads on an outer surface of the first end of the end cylinder housing.

6. The pump system of claim 1, further comprising a bracket positioned within the joint housing and configured to couple the piston rod to the plunger rod.

7. The pump system of claim 1, further comprising one or more supports configured to stabilize at least one of the ram housing, joint housing, and end housing, the one or more supports having a first end coupled to an exterior surface of at least one of the ram housing, joint housing, and end housing, and a second end coupled to a surface, where the one or more supports span less than the entire length of a housing to which they are coupled.

8. The pump system of claim 7, where the one or more supports are further configured to dampen vibration of the ram housing, joint housing, and end housing relative to the surface.

9. The pump system of claim 1, where the second first end of the end cylinder housing further includes a radially expanded portion having an interior surface and an exterior surface, the radially expanded portion configured to receive:

a piston wear ring having an exterior surface and interior surface, the piston wear ring configured to contact and reduce wear of the plunger rod as it reciprocates in the end cylinder housing;

a plurality of seals configured to seal an annulus between an external surface of the plunger rod and an internal surface of the end cylinder housing, and a retaining nut having an exterior surface and an interior surface, the nut configured to secure the piston wear ring and plurality of seals circumferentially within the radially expanded portion by coupling the exterior surface of the nut to the interior surface of the radially expanded portion of the end cylinder housing, and further coupling the interior surface of the nut to the exterior surface of the piston wear ring such that piston wear ring and plurality of seals are disposed circumferentially between the interior surface of the nut and the exterior surface of the plunger rod of the end cylinder housing.

10. The pump system of claim 9, where the retaining nut is threaded onto the piston wear ring or onto radially expanded portion of the end cylinder housing.

11. The pump system of claim 9, where the piston wear ring is made of a softer material than the plunger rod such that the piston wear ring will substantially wear out from frictional contact with the plunger rod and the plunger rod will not substantially wear out from frictional contact with the piston wear ring.

12. The pump system of claim 9, where the joint housing further includes a connector portion at the second end of the joint housing configured to retain the retaining nut, piston wear ring, and seals circumferentially within the radially expanded portion of the end cylinder housing, the connector portion having one or more lands and grooves that are configured to mate with corresponding lands and grooves on the exterior surface of the radially expanded portion of the end cylinder housing.

13. A method of assembling a well service pump system comprising:

coupling a first end of a plunger rod of a working fluid cylinder to a first end of a piston rod of a hydraulic ram cylinder, the first end of the plunger extending through a first end of an end cylinder housing of the working fluid cylinder and configured to reciprocate within the end cylinder housing, and the first end of the piston rod extending from a second end of a ram cylinder housing of the hydraulic ram cylinder and configured to reciprocate within the ram cylinder housing;

coupling the second end of the ram cylinder housing to a first connector portion of a joint housing of a structural joint, where the first connector portion is located at a first end of the joint housing;

coupling the first end of the end cylinder housing to a second connector portion of the joint housing of the structural joint, where the second connector portion is located at the second end of the joint housing, and securing the first connector portion of the joint housing to the second end of the ram cylinder housing by mating one or more lands and grooves of the first connector portion of the joint housing with corresponding lands and grooves on the second end of the ram cylinder housing and further securing the second connector portion of the joint housing to the first end of the end cylinder housing by mating one or more lands and grooves of the second connector portion of the joint housing with corresponding lands and grooves on the first end of the end cylinder housing, where the structural joint is configured to maintain the distance between and resist bending of the end cylinder housing and ram cylinder housing.

14. The assembly method of claim 13, further comprising removably coupling a plurality of joint housing pieces together to define the joint housing, the joint housing pieces each extending a full length of the joint housing.

15. The assembly method of claim 13, further comprising securing the first connector portion to the second end of the ram cylinder housing with a plurality of bolts extending through the first connector portion into the ram cylinder housing and further securing the second connector portion to the first end of the end cylinder housing by a threading a nut onto the outer surface of the first end of the end cylinder housing.

16. The assembly method of claim 15, further comprising securing the first connector portion to the ram cylinder housing before securing the second connector portion to the end cylinder housing.

17. The assembly method of claim 13, further comprising:

positioning a plurality of seals and a piston wear ring within a radially expanded end portion of the end cylinder housing, the plurality of seals configured to seal an annulus between an external surface of the plunger rod and an internal surface of the end cylinder housing, and the piston wear ring configured to reduce wear of the plunger rod as it reciprocates in the end cylinder housing; and securing the plurality of the seals and piston wear ring within the end cylinder housing with a retaining nut, the retaining nut configured to be coupled to an exterior surface of the piston wear ring and an interior surface of the radially expanded portion of the end cylinder housing.

18. The assembly method of claim 13, further comprising coupling a first end of a support to an exterior surface of the ram housing, joint housing, or end housing and a second end of the support to a surface, the support configured to span less than the entire length of a housing.

* * * * *